United States Patent [19]

Jensen

[11] 4,400,125

[45] Aug. 23, 1983

[54] METHOD OF AND APPARATUS FOR CHARGING GROUND HYDROCARBONACEOUS MATERIAL TO A PRESSURIZED GASIFICATION SYSTEM

[75] Inventor: Harbo P. Jensen, Larkspur, Calif.

[73] Assignee: Chevron Research Company, San Francisco, Calif.

[21] Appl. No.: 272,952

[22] Filed: Jun. 12, 1981

[51] Int. Cl.[3] ..... C10J 3/30

[52] U.S. Cl. ..... 414/187; 48/86 R; 414/221; 414/786

[58] Field of Search ..... 414/187, 198, 199, 200, 414/217, 221, 786; 48/86 R

[56] References Cited

U.S. PATENT DOCUMENTS 2,151,514 3/1939 Heinen ..... 414/221

4,302,143 11/1981 Grimminger et al. ..... 414/187 X

*Primary Examiner*—Robert G. Sheridan

*Attorney, Agent, or Firm*—Burns, Doane, Swecker & Mathis

[57] ABSTRACT

Method and apparatus for charging finely ground hydrocarbonaceous material (e.g. coal, shale, liquite, oil sand), to a gasification reactor by gravity and compressed gas is disclosed.

In accordance with the invention, ground coal particles, for example, are supplied by gravity feed to a charge forming hopper and from the hopper to a charging cylinder. The charge is pressured with a volume of gas from 3 to 5 times the volume of the charge to form a cushion of gas above it. Pressure is then increased on the gas cushion, as by a piston in the cylinder, until the pressure in the cylinder exceeds the pressure in the reactor. Such pressure automatically activates a closure arrangement between the cylinder and reactor. The closure arrangement automatically recloses the reactor when pressure between the reactor and cylinder equalizes. Desirably, the closure arrangement is purged by steam prior to closing.

11 Claims, 7 Drawing Figures

METHOD OF AND APPARATUS FOR CHARGING GROUND HYDROCARBONACEOUS MATERIAL TO A PRESSURIZED GASIFICATION SYSTEM

FIELD OF THE INVENTION

The present invention relates to a method of and apparatus for supplying finely ground hydrocarbonaceous material such as coal, shale, lignite, oil sand and the like, to a pressurized reactor wherein such material is gasified. More particularly, the invention relates to a method of periodically, or cyclically, charging a gasification reactor with such finely ground hydrocarbon containing materials by gravity and compressed gas, without the use of conventional lock boxes.

It is a particular object of the present invention to transfer such finely ground hydrocarbonaceous material from a supply hopper at substantially atmospheric pressure to a reactor operating at elevated pressure and temperature. In a preferred form, comminuted hydrocarbon material, such as ground coal, is fed by gravity from a hopper into a charging cylinder above the reactor. The hopper is then closed off and gas pressure is applied to the charge. Preferably such pressure is applied by a piston in the cylinder to a "cushion" of gas interposed between the charge of finely comminuted coal and the piston head. The gas may be supplied either from an external source or by air trapped between the charge and the piston. When the applied cylinder pressure exceeds the pressure in the reactor, closure means for the cylinder opens and the charge is automatically injected into the reactor. After discharge, pressure in the charging cylinder and the reactor equalizes, and the closure means closes off the reactor so that pressure in the cylinder is reduced. The cylinder may then be charged again with ground material and pressurized with gas. By gas pressurizing, including pressure added by the piston stroke, gravity feed of the charge can be substantially vertically downward into the reactor against the reactor pressure. Such flow is countercurrent to upwardly flowing gas in the reactor to assure maximum efficiency due to contact of the coolest comminuted hydrocarbon material with the hottest generated gas.

In a preferred form of apparatus, the charge is cushioned from the piston operating in the charging cylinder by gas injected either after, or as, the piston closes off the charging cylinder from the feed hopper.

BACKGROUND OF INVENTION

Gasification of hydrocarbonaceous material, such as coal, shale, lignite or oil sands, usually involves reaction of ground particles of such material with steam at high pressures. Oxygen may be added to provide the endothermic heat of reaction for steam decomposition by partial oxidation of the hydrocarbon containing material. Generally, the reaction is promoted by catalyst, such as iron-chromia compositions. Efficiency of the reaction is promoted by grinding the coal or shale to particle sizes of less than 4 mesh screen size (4.76 mm), and preferrably less than 8 mesh (2.38 mm). Normally, the material is ground in water to control dust and then at least partially dried. In such condition, the hydrocarbonaceous material is in a fine grain or dust-like form so that interaction with gases in the reactor occurs within a few seconds. Accordingly, free flow into the reactor is essential. For such free flow, at reasonably high feed rates, a charging system is essential because of high pressure (on the order of 5 to 80 atmospheres) in the reactor. Additionally, in gasification of solid and liquid hydrocarbons, hydrogen sulphide, carbon monoxide, as well as desired methane, are produced. All of these gases are air pollutants, if released. Accordingly, an isolation chamber, or lock-box, (frequently multiple stages) must be used for flow between a feed hopper and the reactor chamber. For high flow rates, such lock chambers must be large and be able to withstand the pressure in the reactor. Both requirements increase the cost of such chambers. For these reasons, it has been proposed to use relatively small volume lock-boxes with an expansible chamber provided by a cylinder with a reciprocating piston to vary the pressure in the box. Gates or valves are provided for admitting and withdrawing the ground hydrocarbonaceous material.

Where such finely ground material is mechanically forced into the reactor by a piston either sliding laterally or vertically from below, some agglomeration or compaction results. Material being pressed by the piston is compressed against the balance of the charge. This then requires subsequent recomminution of the compacted particles.

Further, hydrocarbon containing materials, such as coal, shale, lignite and oil sand, generally include rock particles such as quartz, limestones, and clays. These materials are particularly abrasive to pistons, cylinders and sliding gates in typical lock-box constructions of the prior art.

U.S. Pat. No. 3,039,939, Welsh, discloses charging a shale retort from the bottom by a mechanical cylinder and piston arrangement. Raw shale flows downwardly to fill an inclined cylinder. The cylinder then pivots from the inclined, fill position to vertical to mate with a bottom entry port in the reactor. The piston then physically lifts the raw shale in the cylinder so that each new charge of shale displaces a portion of the shale undergoing reaction upwardly within the retort.

U.S. Pat. No. 4,207,081, Preusser, et al., discloses a double-piston pump arrangement for pumping fine grained, or dustlike, coal through a lock-box arrangement from a supply hopper to a reactor or gasifier. The piston includes a central chamber which transports the granular coal horizontally when the piston is actuated between its two horizontal extreme positions, one to admit ground coal to the chamber and one to discharge it into the reactor.

U.S. Pat. No. 3,994,418, Andersson, discloses a similar horizontal feed cylinder having a pair of independently reciprocable pistons therein. Feed material is compressed between the two pistons and charged to a gas generator at an elevated pressure. The space between the two pistons is then closed to prevent reactor gas entrapment between the pistons during return of the pistons to the feed intake position.

U.S. Pat. No. 2,151,514—Heinen discloses a system for conveying solids or liquids either to a high pressure zone from a low pressure zone, or vice versa. A lock box arrangement is formed by a pair of gate valves. The gates are cam operated by a crank shaft which drives a piston rod and a piston reciprocable in a cylinder open to the lock-box. The piston controls the cylinder and lock-box pressure as the gates are opened and closed for transfer of solids or liquids.

U.S. Pat. No. 4,082,366—Duff et al. discloses a similar arrangement for recycling polyurethane foam wherein pieces of foam to be recycled are enclosed in a lock-box formed by a pair of gate valves. The gates are successively closed and opened between a feed line and the reactor. A piston and cylinder arrangement exerts pressure on the foam particles to move them through the gate valve between the lock-box and reactor.

U.S. Pat. No. 2,888,155—Raynier et al. shows an arrangement for introducing edible grains into a pressurized steam reactor for manufacture of puffed cereals (e.g., puffed wheat). In this system a lock-box is formed by a pair of pistons operating in interconnected cylinders. Reciprocation of the pistons relative to each other opens and closes the inlet feed, the lock-box and entry to the reactor in the proper order to permit transfer of the cereal. The wall of one piston and the head of the other piston serve as gates for the lock-box arrangement.

As particularly distinguished from such prior art methods and structures, the present invention contemplates formation of finely ground materials, including abrasive rock particles, by gravity feed into a charging cylinder vertically above a reactor and then compressing a gas volume above the charge. Such compression is applied only in an amount and to an extent sufficient to exceed the pressure in the reactor to actuate an end closure plate extending across the charging cylinder. The charge is thus uniformly pressured without agglomeration of the ground particles and at the same time the piston head need not contact the charge. This substantially avoids scraping or scoring action of the cylinder and piston by particles, and particularly those that may be wedged into the space defined by the cylinder, piston walls and the piston rings. In addition, such a system permits addition of small amounts of water or steam to the charge and along the cylinder walls without significant compaction of the particles. In simplest form, air enters the charging cylinder with the gravity flow of ground material. It is then compressed by the piston to create the necessary pressure in the cylinder to actuate the pressure responsive closure means.

A preferred manner of practicing the method of the invention includes introduction of a gas "blanket" between the compressing piston and the charge from an external source such as, oxygen, nitrogen or combustion gas. However, if desired, a "bleed" line from the reactor may be opened to supply such gas above the charge after the cylinder is sealed by the piston. In the latter method, contamination of the reaction product by nitrogen is reduced.

Also in accordance with the preferred method, the gravity feed hopper is closed prior to application of pressure to the charging chamber to permit refilling of the hopper while a charge is being transferred to the reactor in the charging cylinder. Desirably but not necessarily, the top of the feed hopper may also be closed off to prevent back flow of fines due to even a low back pressure in the feed hopper.

Further objects and advantages of the invention will become apparent from the following detailed description of preferred steps and means for carrying out the methods and apparatus of the present invention.

DESCRIPTION OF PREFERRED EMBODIMENTS

Figure 1:
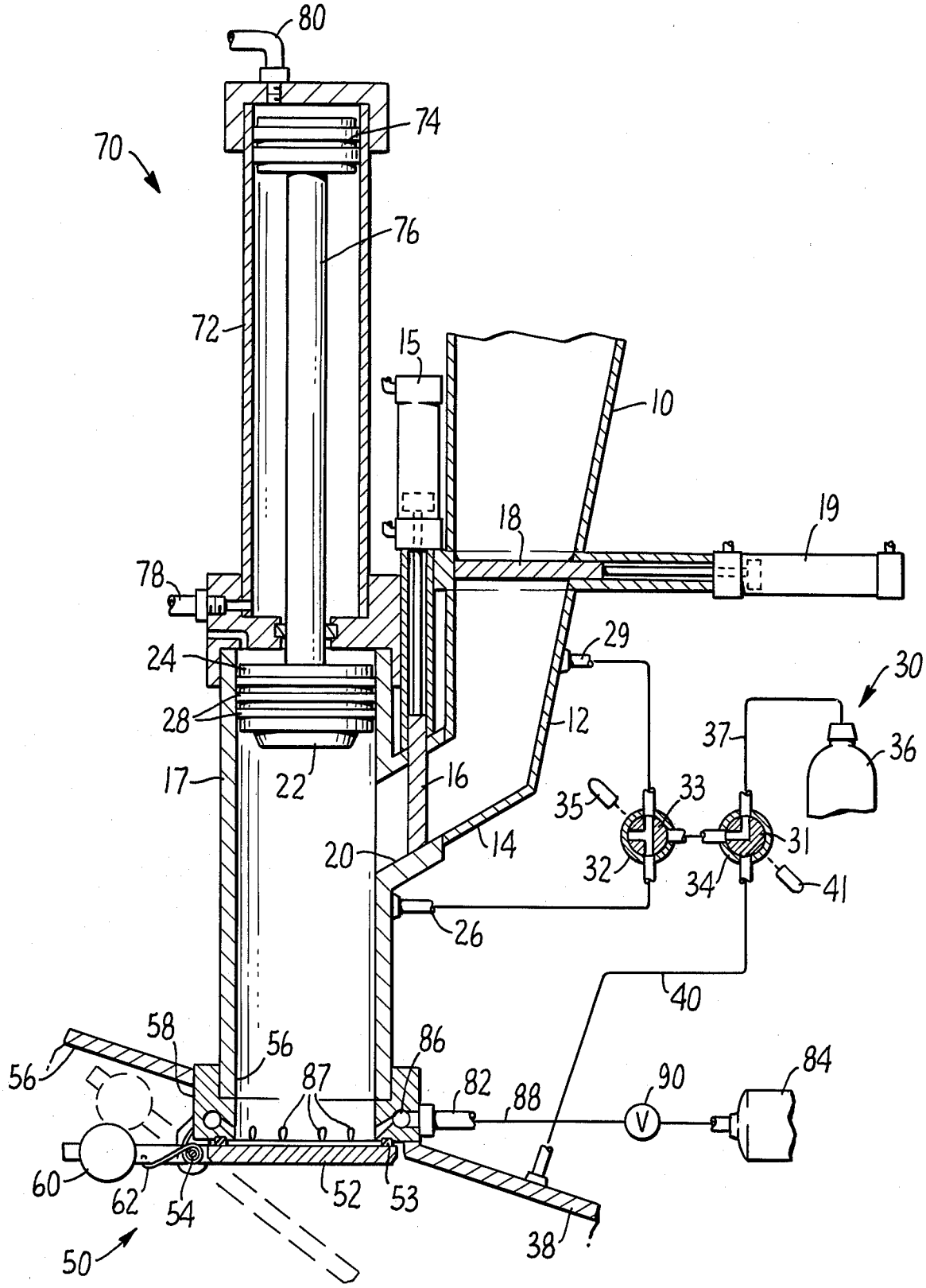
FIG. 1 is a vertical cross-sectional view of a preferred form of apparatus for carrying out the methods of the present invention as sequentially illustrated by FIGS. 2A–2F inclusive.

In accordance with the present invention, FIG. 1 illustrates a gas pressure responsive feed system for supplying finely ground hydrocarbonaceous material to a gasification reactor operating at high pressure and high temperature.

As there shown, ground hydrocarbon, particularly coal, from a supply hopper 10 is introduced into a feed hopper 12. A charge of a predetermined size may then flow by gravity into charging cylinder means 17 through inclined chute means 14 when gate 16 is raised. As indicated, feed hopper 12 may be sized by gate 18 closing off supply hopper 10 to establish the predetermined charge size. In this way, in accordance with this invention, the volume of cylinder 17 below entry chute 20 permits head 22 of piston means 24 to include a volume to form the necessary gas cushion above the ground coal particles. Such gas may be introduced by line 26 connected to cylinder 17 so that it is above the charge but sufficiently below entry 20 to permit piston rings 28 to seal off cylinder 17 from entry 20.

A gas flow control system, indicated generally as 30, includes valves 32 and 34 which permit connection to a source of compressed gas, such as tank 36 containing nitrogen by line 37 or to the high pressure gas atmosphere of reactor 38 through line 40. Gas circuit 30 also performs an important function in transfer of the charge from feed hopper 12 to cylinder 17 by permitting equalization of pressures in the two volumes for free flow of particles by gravity. As indicated, rotating element 33 of valve 32 may be turned by operating means, such as handle 35, to either of two positions. In one position of valve element 33 line 26 is connectable to line 29 opening into the upper end of feed hopper 12. In the other, line 26 may be connected through rotating element 31 of valve 34 either by line 37 to tank 36 or by line 40 to reactor 38. Handle 41 may be used to rotate valve element 31 to either of these two positions. Additionally, element 31 may be rotated to a center position to close off both lines 37 and 40 when valve 32 connects lines 26 and 29 for gravity fill of cylinder 17.

Pressure responsive closure means 50 includes end closure plate 52 supported for pivotal rotation by hinge means 54 at the side of lower end 56 of cylinder 17. In the present embodiment, hinge 54 is supported by wall 56 of reactor 38 through collar 58. Counter weight 60 is adjustable on plate arm 62 extending on the side of plate 52 as a lever arm pivoting on hinge 54 to form adjustable biasing means. Such biasing means, (which may also include springs, not shown) provides a pressure responsive system to control the pressure required by piston head 22 acting on the charge in cylinder 17 through the gas cushion to rotate plate 52 to the open (dotted) position. Piston 24 is reciprocated in cylinder 17 by piston actuating means 70, which includes cylinder 72 and piston 74 mounted on the upper end of piston rod 76. Piston 74 is driven up or down in cylinder 72 by hydraulic or pneumatic fluid supplied and discharged through lines 78 and 80 connected to the opposite ends of cylinder 72.

Ground coal, or other particulated or comminuted hydrocarbon materials, may be is subject to "coking" at the lower end of cylinder 17 and closure plate 52 because of their exposure to reactor heat. Most particularly, plate seal ring 53 is subject to such conditions. Further, the nature of such finely ground material contributes to contamination of these surfaces. Accordingly, flushing means 82 are disposed around mounting collar 58. In the arrangement shown, steam, at a pressure exceeding that in reactor 38, is supplied from source 84 to manifold 86 through line 88 and valve 90. Manifold 86 then supplies steam to flushing jets 87 disposed around the wall of collar 58 to spray steam on plate 52 and ring 53 after coal particles are pumped into reactor 38.

As indicated, gate 16 and 18 for metering raw coal particles into and out of feed hopper 12 are hydraulically controlled respectively by drive means 15 and 19, respectively. These are also piston and cylinder arrangements driven pneumatically or hydraulically.

FIGS. 2A through 2F illustrate a preferred sequence of steps to perform the method of the present invention, using the apparatus of FIG. 1.

Figure 2A:
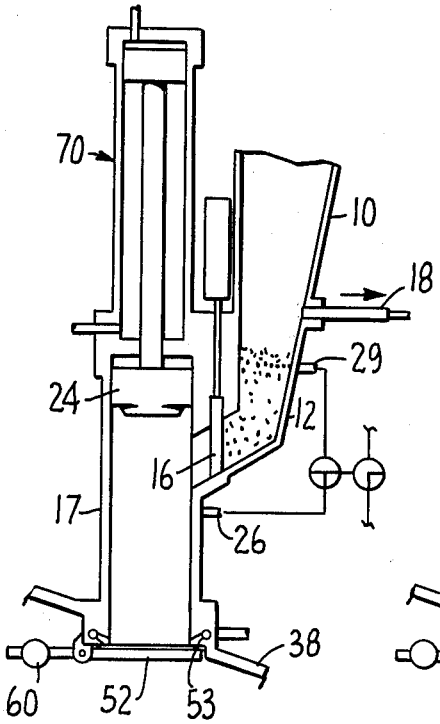
FIG. 2A is a vertical cross sectional view of the apparatus of FIG. 1 illustrating initial fill of the feed hopper with ground hydrocarbonaceous material to form a charge to the charging cylinder.

Specifically, FIG. 2A shows ground hydrocarbonaceous particles, finely ground coal, being loaded from supply hopper 10 into feed hopper 12 with gate 18 retracted and gate 16 blocking discharge of particles to cylinder 17. At the start of such a cycle, piston 24 is retracted to the top of cylinder 17. Plate 52 is closed on ring 53 in reactor 38 by gasification reaction pressure in reactor 38 and counterweight 60.

Figure 2B:
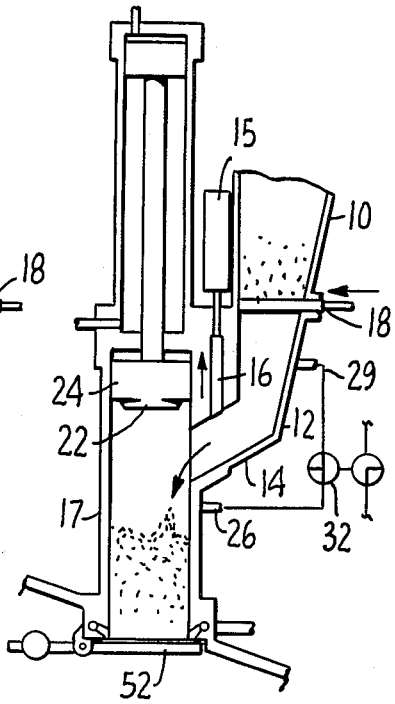
FIG. 2B is a view similar to FIG. 2A showing gravity feed of the charge to the charging cylinder and reloading of the supply hopper.
Figure 2C:
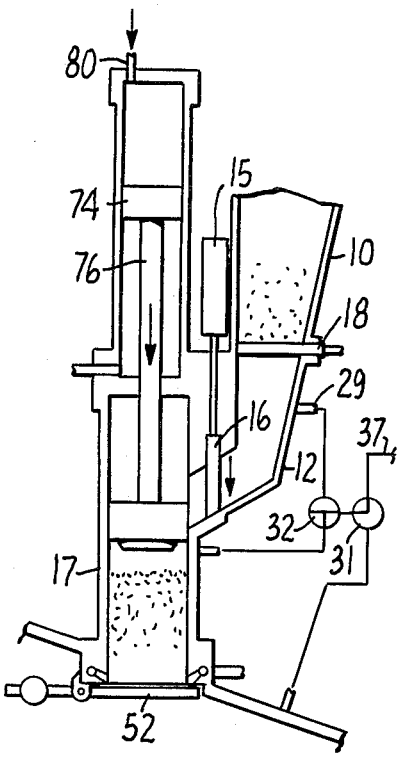
FIG. 2C is a view similar to FIGS. 2A and 2B showing closure of the feed hopper chute and the piston means applying gas pressure above the charge.

FIG. 2B illustrates, in a view similar to FIGS. 2A et seq, introducing by gravity flow the contents of feed hopper 10 into charging cylinder 17 by retracting gate 16. Gate 18 is closed in this step to permit refilling of feed supply 10 and to prevent possible blow-back of fines if pressure in chamber 17 and feed hopper 12 is greater than that in supply bin or hopper 10. In this view it is to be particularly noted that the volume of charging cylinder or chamber 17 is greater than the volume of feed hopper 12. Specifically, the volume of the charge in cylinder 17 must be such that a "blanket" or "cushion" of gas can be injected between the face of piston 22 and the coal charge so that there will be little or no mechanical compaction of the fine coal particles by the piston acting directly thereon. FIG. 2C specifically illustrates this condition. As mentioned above, piston rings 28 on piston 24 will seal the wall of cylinder 17 below entry port 20 of chute 14 to form such a gas space above the ground coal charge. Preferably, but not necessarily, gate 16 will close at this point in the cycle to permit reloading of feed hopper 12. Such closure, along with holding gate 18 closed, further pressure isolates cylinder 17 and reactor 38 from inadvertent release of gas to the atmosphere or possibly creating back-flow of dust or fines that may not have entered charging cylinder 17. If desired, the gas may be air taken in with the charge from feed hopper 12. However, preferably gas is introduced through line 26, either from a separate source or from a gas bleed line 40 into reactor 38.

Figure 2D:
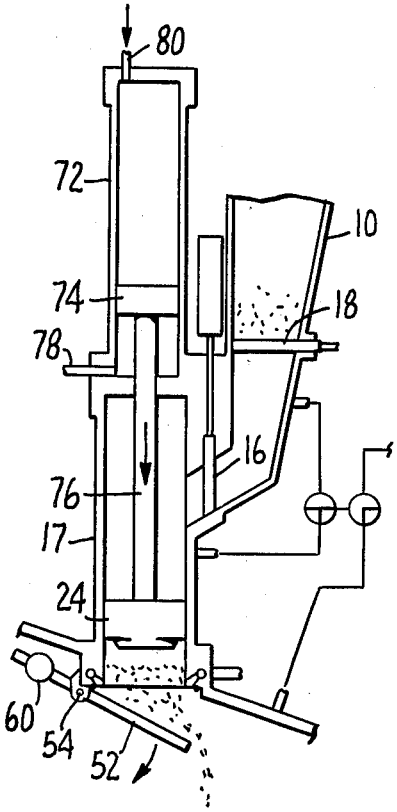
FIG. 2D is a view similar to FIGS. 2A–2C showing actuation of the pressure responsive closure plate means in response to pressure in the cylinder exceeding that in the reactor.

In the method, proceeding from the state shown in FIG. 2C, to that shown in FIG. 2D, pressure is applied to the gas above the charge in cylinder 17. Desirably, the volume of such gas is about 3 to 5 times the volume of the charge. When the pressure exceeds a predetermined value, as set by pressure responsive closure means 50, plate 52 trips against the pressure in reactor 38 and the biasing force set by counter weight 60 on lever arm 62. Such action dumps the charge into reactor 38 without mechanical compaction. Thus, all of the comminuted coal particles may promptly react with the hot gases being generated in reactor 38.

Figure 2E:
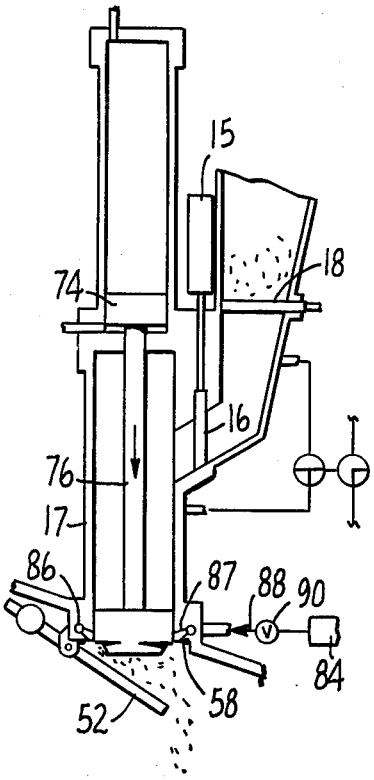
FIG. 2E is a view similar to FIGS. 2A–2D illustrating application of steam to the piston head and closure plate after discharge of hydrocarbon particles into the reactor.

As indicated in FIG. 2E, piston 24 drives head 22 through the open end of cylinder 17 and desirably dwells in that position to hold closure plate 52 open against the closing force of bias means 60. This permits steam to be introduced into manifold 86 to spray the exposed surfaces of plate 52, seal 53 and collar 58 clean of hydrocarbon material. Such action helps prevent coking of these surfaces which may interfere with long-term, repetitive operation of the charging system of this invention. The pressure of such steam is, of course, sufficient to exceed the ambient pressure of reactor 38.

Figure 2F:
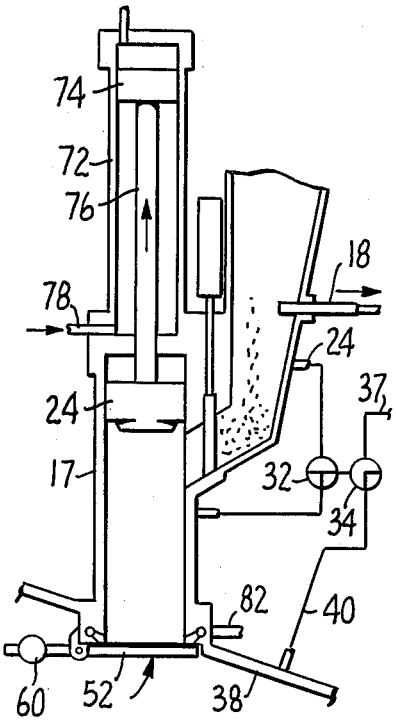
FIG. 2F is a view similar to FIGS. 2A–2E showing reloading of the feed hopper from the ground material supply hopper to initiate a repeat of the cycle beginning in FIG. 2A.

FIG. 2F illustrates reloading of feed hopper 12 after completion of the prior cycle. It includes closing of plate 52 and retracting of piston 24 above entry port 20. In this phase of the cycle, gate 18 is again opened to admit a predetermined quantity of ground coal to enter feed hopper 12. Plate 52 is closed not only by bias means 60, but also by the pressure in reactor 38, since that pressure substantially exceeds the pressure in cylinder 17 when piston 24 is retracted. In general, retraction of piston 24 will result in the pressure in cylinder 17 falling to substantially atmospheric pressure. However, if higher pressures in reactor 38 require similarly higher pressures in cylinder 17, venting to atmosphere can be provided by way of line 26 or a separate line and valve arrangement (not shown).

From the foregoing description of preferred forms of apparatus for carrying out the method of the invention, it will be apparent that a pressure responsive feed system for supplying ground hydrocarbonaceous material to a gasification reactor is provided which permits rapid, cyclical throughput. Such throughput rates are made possible by gas pressurization of the feed charge supplied by free gravity flow into a pressurizing cylinder and retention therein only so long as is required to compress the gaseous head above the charge to actuate the pressure responsive means through the particulate material. Pressure so applied to the body of particles will cause relatively little compaction and agglomeration of the particles, because in effect, gas flow through the "fluffed" particles, fluid pressure of the gas is equalized throughout the charge. Further, the gas pressure reacts directly through the charge pore space of the charge (by way of the open permeability channels between particles) to act directly on the surface area of plate 52 of pressure responsive closure means 50. This action particularly distinguishes from all previously known forms of prior art methods and apparatus where direct mechanical movement of the particles inevitably results in compaction due to filling of void spaces within the charge by smaller particles mechanically bridging on larger particles. In the present invention certain other unforeseeable advantages arise from such operation. Primary among these advantages is lessening of mechanical abrasion and scoring of the common steel walls of cylinder and piston by non-reactive rock particles in the charge which have a hardness greater than such steel. Without mechanical compaction, hard rock particles are not as likely to be wedged between the piston, piston rings and cylinder walls by movement of the piston walls.

Various modifications and changes in the present invention will be apparent to those skilled in the art from the foregoing description of the preferred forms. Among such modifications is application of the method, and apparatus of the present invention to supply hydrocarbon particles to a recycle stream of solid, unreacted particles from a reactor output back into the same reactor, or as feed into a second reactor. It will also be apparent that the requirements of the gravity feed system, as disclosed above, will operate with less than vertical flow of the charge material. In particular, so long as the "angle of repose" of the charge particles is exceeded in feed hopper 12 and charging cylinder 17, the method may be carried out. Other modifications or changes coming within the scope of claims, forming a part of this specification, are intended to be included therein.

What is claimed is:

1. Method of feeding comminuted ground hydrocarbonaceous material to a hydrocarbonaceous gasification reactor operating at an elevated pressure without use of a conventional lockbox which comprises filling a feed hopper by gravity and at substantially atmospheric pressure with ground hydrocarbonaceous particles of less than about 4 mesh, introducing by gravity flow the contents of said hopper into a charging cylinder interconnected between said feed hopper and the reactor, said charging cylinder having a volume greater than the volume of said feed hopper, closing off said feed hopper from said charging cylinder to enclose said charge of particles in said cylinder, introducing a predetermined volume of gas into said charging cylinder above said charge, applying a predetermined pressure to said gas volume and through said gas volume to said hydrocarbonaceous particle charge, releasing the contents of said cylinder to said reactor in response to said predetermined pressure in said charging cylinder exceeding the pressure in said gasification reactor, and then closing said gasification reactor from said charging chamber in response to reduction of pressure in said cylinder to the pressure in said reactor to permit addition of a further charge of ground hydrocarbonaceous material from said feed hopper to said charging chamber.

2. The method of claim 1 wherein said closing off of said feed hopper and said introducing of said predetermined volume of gas are performed simultaneously.

3. The method of claim 1 wherein the volume of said predetermined pressure is applied to said charge by piston means reciprocable in said charging chamber and said volume of gas is sufficient to prevent contact between the head of said piston means and said charger.

4. The method of claim 1 wherein the pressure in said charging cylinder is substantially equalized with the pressure in said feed hopper prior to introducing said contents of said feed hopper to said charging cylinder.

5. The method of claim 1 wherein the said predetermined volume of gas is selected from the group consisting of air, nitrogen, products of combustion and mixtures thereof.

6. The method of claim 1 wherein said volume of said gas introduced into said cylinder is from about 3 to 5 times the volume of said ground material introduced into said cylinder.

7. Apparatus for supplying ground hydrocarbon material, such as coal, lignite, shale, oil, sands, and the like, to a gasification reactor operating at an elevated pressure which comprises means forming a charging cylinder generally disposed above said reactor, said cylinder having vertically reciprocable piston means operable therein, said cylinder having a charging hopper positioned laterally and above said cylinder, said hopper being substantially smaller in volume than the volume of said cylinder when said piston is fully retracted, inclined chute means interconnecting the bottom of said hopper to the upper end of said charging cylinder and below the retracted position of said piston means, pressure responsive closure means for the lower end of said cylinder, said closure means including an end closure plate having a diameter to extend across the diameter of said cylinder for closure thereof, hinge means for pivotally mounting said closure plate to permit said plate to pivot relative to one side of said cylinder to open fully the end of said cylinder, adjustable biasing means for returning and holding said end closure plate in a closed position when pressure in said reactor is equal or more than the pressure in said cylinder and means for actuating said piston to compress a gas charge above said ground hydrocarbon material introduced into said cylinder to a pressure sufficient to exceed the pressure in said reactor and thereby to activate said end closure plate to rotate about said hinge means to open said cylinder against said biasing means for addition of ground hydrocarbonaceous material to said reactor, and whereby said closure plate is pivoted by said biasing means to reclose said reactor when said activating piston is retracted.

8. Apparatus in accordance with claim 7 wherein gate means are positioned in said inclined chute means to close off said charging hopper when said piston is actuated to compress said gas above said ground hydrocarbonaceous material.

9. Apparatus in accordance with claim 7 with the addition of means for closing off the upper end of said hopper from the atmosphere to prevent back flow of fines from said ground hydrocarbonaceous material during admission of said material to said charging cylinder.

10. Apparatus in accordance with claim 7 wherein said pressure responsive closure means further includes means for flushing the closure surfaces between said closure plate and the end of said cylinder, said means comprising a plurality of spray nozzles disposed around said surface, a source of steam connected to said nozzle, and means for controlling flow of steam from said source to said nozzles.

11. Apparatus in accordance with claim 7 which includes means for decreasing the pressure in said cylinder to substantially atmospheric pressure after said closure plate recloses said reactor.

* * * * *